US006546039B2

(12) United States Patent
Fishman et al.

(10) Patent No.: US 6,546,039 B2
(45) Date of Patent: Apr. 8, 2003

(54) SIMULTANEOUS INDUCTION HEATING AND STIRRING OF A MOLTEN METAL

(75) Inventors: Oleg S. Fishman, Maple Glen, PA (US); John H. Mortimer, Medford, NJ (US); Vladimir V. Nadot, Voorhees, NJ (US)

(73) Assignee: Inductotherm Corp., Rancocas, NJ (US)

( * ) Notice: Subject to any disclaimer, the term of this patent is extended or adjusted under 35 U.S.C. 154(b) by 0 days.

(21) Appl. No.: 10/078,790

(22) Filed: Feb. 19, 2002

(65) Prior Publication Data

US 2003/0016724 A1 Jan. 23, 2003

Related U.S. Application Data

(60) Provisional application No. 60/269,666, filed on Feb. 16, 2001.

(51) Int. Cl.[7] ..... F27D 23/04; H05B 6/34

(52) U.S. Cl. ..... 373/146; 373/148

(58) Field of Search ..... 373/7, 59, 138, 373/139, 144, 145, 146, 147, 148, 149, 150, 151; 219/663, 669, 671

(56) References Cited

U.S. PATENT DOCUMENTS 3,536,983 A * 10/1970 Kennedy ..... 373/146
5,012,487 A * 4/1991 Simcock ..... 373/147

* cited by examiner

*Primary Examiner*—Tu Ba Hoang
(74) *Attorney, Agent, or Firm*—Philip O. Post

(57) ABSTRACT

Molten metal, or other electrically conductive material, in a vessel can be inductively heated, and simultaneously inductively stirred. A single-phase ac supply provides induction heating power to at least one set of three induction coil sections surrounding the vessel. A three-phase ac supply provides induction stirring power to at least one set of three induction coil sections surrounding the vessel. The single-phase ac supply is capacitively connected to the coil sections to form a heat resonance circuit, and the three-phase ac supply is inductively connected to the coil sections to forma a stir resonance circuit. The heat circuit capacitive elements provide a sufficient impedance to the output of the three-phase ac supply to block power transfer from its output to the input of the single-phase supply. The stir circuit inductive elements provide a sufficient impedance to the output of the single-phase supply to block power transfer from its output to the input of the three-phase supply.

16 Claims, 7 Drawing Sheets

SIMULTANEOUS INDUCTION HEATING AND STIRRING OF A MOLTEN METAL

CROSS REFERENCE TO RELATED APPLICATIONS

This application claims the benefit of U.S. Provisional Application No. 60/269,666, filed Feb. 16, 2001.

FIELD OF THE INVENTION

The present invention is in the technical field of inductively heating and stirring electrically conductive molten materials wherein the heating and stirring can be accomplished simultaneously.

BACKGROUND OF THE INVENTION

It is well known in the art to melt an electrically conductive material, such as a metal, to heat the molten metal (or melt), and to hold the melt at a temperature by placing the metal in an induction furnace or holding crucible and magnetically coupling the metal to an ac magnetic field. The field is produced in one or more induction coils surrounding the crucible by the flow of ac current from a power source. To maintain sufficient electromagnetic stirring, the electrical frequency of the current is reduced as the furnace capacity increases and the applied ac induction power (and current) increases. For example, a furnace with a melt capacity of 35,000 pounds (16 tonnes) of iron has an optimal power supply frequency of approximately 150 Hz, whereas a furnace with a melt capacity of 5,000 pounds (2¼ tonnes) of steel has an ideal power supply frequency of approximately 600 Hz.

It is also well known that a melt subjected to an ac magnetic field will move when eddy currents generated in the melt by the applied field produce a flux field that opposes the applied magnetic field. Generally, fields produced by higher frequency currents will result in little stirring action and fields produced by lower frequency currents will result in preferred electromagnetic stirring motions with circular-like flow streams through the melt. Further the turbulence of the flow will increase as the magnitude of the applied field (supplied current) is increased.

For some melt compositions and applications, the pre-selected frequency of a single ac power supply may provide both heating and stirring actions that are sufficient for the process. In other applications, separate heat and stir frequencies may be used. There are numerous prior art approaches to applying ac power to a melt at two different frequencies to achieve the heating and stirring functions. Earlier approaches focused on using switching arrangements that alternatively isolated heating and melting power sources from the induction coil sections. Switching arrangements are disadvantageous in that they do not allow for simultaneous heating and stirring of the melt and require additional system components.

Later approaches focused on system topologies that simultaneously applied heating power (operating at a pre-selected heat frequency) and stirring power (operating at a pre-selected stir frequency). A significant technical problem to be overcome in these systems is adequate electrical isolation between the simultaneously connected heating and stirring ac power supplies. Failure to provide this isolation when electronic ac power sources are used can result in component malfunction or failure in a power supply that has its output connected to a second power supply operating at a different output voltage and/or frequency.

One solution to this technical problem is identified in U.S. Pat. No. 5,012,487, entitled Induction Melting (the 487 patent). FIG. 1 is a simplified schematic that represents the prior art teachings of the 487 patent. In FIG. 1 an electrostatically screened three-phase transformer 126, having primary windings 124 and secondary windings 128, is used to provide stirring power to three coil sections, 114*a*, 114*b* and 114*c*, that make up an induction coil for an induction melting vessel. Stirring power is provided from a 50 Hz, three-phase power source 120 (utility service power). The transformer also uses a tertiary three-phase winding 127 that feeds a three-phase delta-connected power factor correction arrangement (not show in the simplified schematic). Capacitors 138*a*, 138*b* and 138*c* are connected to the three coil sections as shown in FIG. 1. The high voltage single-phase output of the heating power source 136, operating in the frequency range of 150 Hz to 10 kHz, provides heating power to the coil sections through the capacitors. By selecting the impedance of the capacitors, the coil sections and the secondary of transformer, so that the resultant L-C series circuit is at resonance for the operating frequency of the heating power supply, heating power is transferred from the heating power supply to the coil sections. The 50 Hz stirring power source, operating at off-resonant frequency, is impeded from being applied to the input terminals of the heating power source 136 by the tuned series-resonant circuit. Conversely, heating power is blocked from the stirring power source since the secondary windings of transformer 126 are effectively in parallel at the operating frequency of the heating power source.

There are a few disadvantages to the circuit arrangements disclosed in the 487 patent. Power transformer 126 is an expensive component with voltage tap changers (not shown in the simplified schematic) and the tertiary winding as further described in the 487 patent. Further the operating frequency difference between the heat power source and the stir power source must exceed a certain range for the series resonant circuit to operate effectively. This is particularly problematic for large capacity induction melting vessels.

Therefore, there exists the need for apparatus for and method of simultaneously induction heating and stirring a melt from two separate power supplies, without the use of isolation transformers or switches, wherein the frequency of stir power supply (and induced stir field) is less than the frequency of the heat power supply (and induced heat field), particularly when the frequency of the heat power supply is close in frequency of the stir power supply.

BRIEF SUMMARY OF THE INVENTION

In one aspect, the invention is apparatus for and method of simultaneous induction heating and stirring of an electrically conductive material in a vessel having at least one set of three interconnected induction coil sections disposed around the vessel. Inductive heating of the electrically conductive material is accomplished by applying single-phase ac power across the coil sections via one or more tuning capacitors and stirring of the electrically conductive material is accomplished by applying three-phase ac power to the coil sections via one or more inductors. The capacitive heating circuit and the coil sections operate at or near a first resonant point and the inductive stir circuit and the coil sections operate at or near a second resonant point to block power transfer between the sources of the single-phase and three-phase ac power.

These and other aspects of the invention are set forth in the specification and claims.

BRIEF DESCRIPTION OF THE DRAWINGS

The figures, in conjunction with the specification and claims, illustrate one or more non-limiting modes of practicing the invention. The invention is not limited to the illustrated layout and content of the drawings.

FIG. 3(*b*) is an elementary schematic diagram of another example for simultaneous induction heating and melting of an electrically conductive molten material in accordance with the present invention using a voltage-fed half bridge converter as the single-phase heating power source and a three-phase dc-to-ac inverter as the three-phase stirring power source wherein the induction coil sections disposed around the vessel are connected in an open-delta configuration relative to the three-phase stirring power source.

FIG. 6(*b*) is an elementary schematic diagram of another example for simultaneous induction heating and melting of an electrically conductive molten material in accordance with the present invention using a voltage-fed half bridge converter as the single-phase heating power source and a three-phase dc-to-ac inverter as the three-phase stirring power source wherein induction coil sections disposed around the vessel are connected in a wye configuration relative to the three-phase stirring power source.

DETAILED DESCRIPTION OF THE INVENTION

Figure 1:
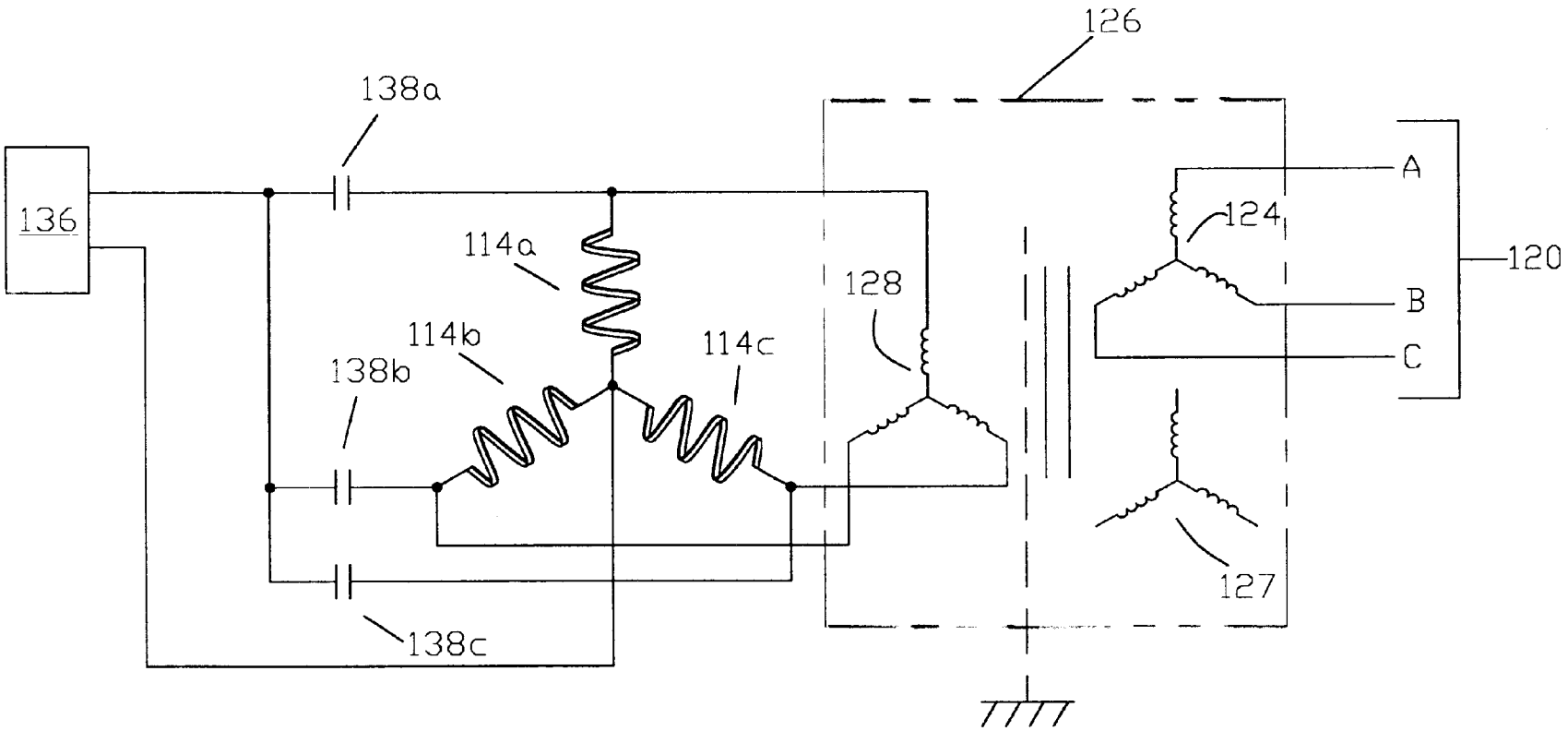
FIG. 1 PRIOR ART
FIG. 1 is a simplified schematic of a prior art arrangement for achieving simultaneous induction heating and stirring of a melt in an induction melting vessel.
Figure 2:
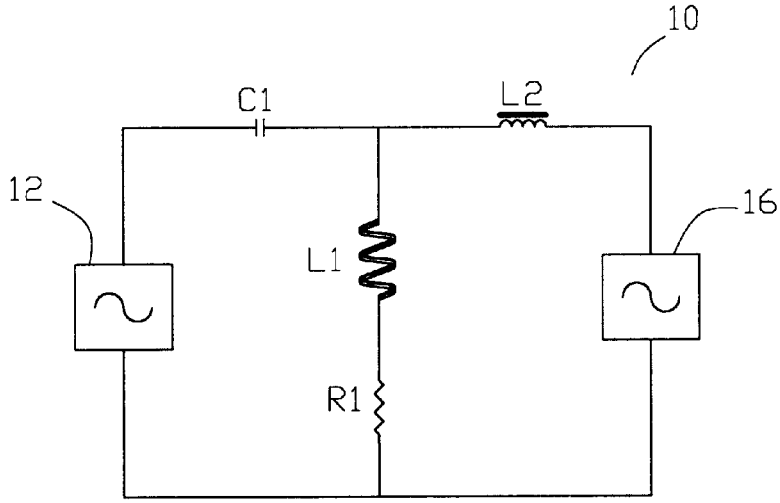
FIG. 2 is a simplified single-line schematic diagram of one example of an arrangement for simultaneous induction heating and melting of an electrically conductive molten material in accordance with the present invention.

There is shown in FIG. 2 a simplified single-line schematic diagram of one example of the simultaneous induction heating and stirring apparatus 10 of the present invention. Single-phase heating source 12 is any type of source that will provide induction heating power to induction coil L1. The coil surrounds a heating vessel or crucible (not shown in the drawing) containing an electrically conductive molten material, or melt. The induction heating power can be used to melt electrically conductive material in the vessel, as well as keep it at a desired temperature once the material has been melted, and while additional material is added to the melt. Therefore, the term "heating" as used herein also encompasses induction heating power for melting material in the vessel. The preferred, but non-limiting, frequency range for a power source that is used to heat the electrically conductive material is from approximately 100 Hz to 100 kHz. C1 represents one or more tuning capacitors that are used to improve the power factor of the C1-L1 series circuit. Power source 16*a* represents one phase of a three-phase stirring power source. The three-phase source is any type of source that can provide electromagnetic stir power to induction coil L1. As further described below, a suitable, but non-limiting, range of output frequency for the stirring power supply is between 1 Hertz and approximately 100 Hertz.

Referring to the example of FIG. 2, for a heating power source 12 operating at a frequency, $f_h$, of 160 Hertz, and an induction coil L1 having an inductance ($L_1$) equal to $50 \cdot 10^{-6}$ Henries, the capacitance ($C_1$) of capacitor C1, which forms a series resonant circuit with coil L1, can be calculated from the equation:

$$C_1 = \frac{1}{\omega^2 L_1}$$

where $T=2Bf_h$. The equation leads to a value of approximately 20 mFarads for $C_1$. Further, for resonance at 160 Hertz, the reactive impedance, $X_{L1}$, of coil L1 will be approximately 0.05 ohms (from the equation $X_{L1}=TL_1$) and the reactive impedance, $X_{C1}$, of capacitor C1 will be approximately 0.05 ohms (from the equation $X_{C1}=1/TC_1$). Coil resistance is represented by resistive element R1. A typical value of induction coil resistance, $\mathbf{R1}_{heat}$, as reflected in the coil L1 load, is approximately 10 percent of the reactive impedance of coil L1. Therefore, $\mathbf{R1}_{heat}$, is approximately equal to 0.005 ohms. For a magnitude of heating power equal to 5 megawatts ($\mathbf{5 \cdot 10^6}$W), the current that the L1-C1 resonant circuit will draw from heating power supply 12 is approximately 31,500 amperes, as calculated from the equation:

$$I = \sqrt{\frac{P}{R1_{heat}}}.$$

For a stirring power source operating at a frequency, $f_s$, of 2.5 Hertz, the resistance, $\mathbf{R1}_{stir}$, of induction coil L1 at 2.5 Hertz can be calculated from the equation:

$$R1_{stir} = R1_{heat}\sqrt{\frac{f_s}{f_h}}$$

as approximately 0.00062 ohms. At the stir frequency of 2.5 Hz, the reactive impedance of coil L1 will be approximately 0.00079 ohms, and the reactive impedance of C1 will be approximately 3.2 ohms. The output of stirring power source 16 is adjusted so that the induction coil L1 draws approximately one-half of the heating current. For this example, the stir current, $I_{stir}$, will be approximately 8,000 amperes. Stir power, $P_{stir}$, can be calculated from the equation: as 40 kilowatts, or 0.8% of heating power. Inductor L2, in the line of the stirring power source 16, is selected to have a relatively high impedance with respect to the impedance of induction coil L1. In this example, the inductor, L2, is selected as $4 \cdot 10^{-3}$ Henries, which is eighty times the inductance of coil L1. At 160 Hertz, the reactive impedance of inductor L2 can be calculated as approximately 4.0 ohms. At 2.5 Hertz, the reactive impedance of inductor L2 can be calculated as approximately 0.006 ohms. The resistance of inductor L2 is ignored since it is significantly smaller in value than the reactance of the inductor.

The following table summarizes the approximate impedance of each passive circuit component for the present example:

| | Impedance (ohms) at Heat Frequency (160 Hz) | Impedance (ohms) at Stir Frequency (2.5 Hz) |
|---|---|---|
| Capacitor C1 | 0.05 | 3.2 |
| Coil L1 | 0.05 | 0.00079 |
| Coil Resistance R1 | 0.005 | 0.00062 |
| Inductor L2 | 4.0 | 0.006 |

As illustrated by the impedance values in the above table for the circuit shown in FIG. 2, the C1-L1-R1 series circuit offers a relatively low impedance path to the output current from heating power source 12. Conversely, inductor L2 effectively blocks current from the heating power source 12 from flowing through stirring power source 16. The L2-L1-R1 series circuit offers a relatively low impedance path to the output current from stirring power source 16, whereas capacitor C1 effectively blocks current from the stirring power source 16 from flowing through heating power source 12.

The following table summarizes the contributions of the heating and stirring power sources to the voltage across, current through, and power used in coil L1:

| | Contribution from Heating Power Source (160 Hz) | Contribution from Stirring Power Source (2.5 Hz) |
|---|---|---|
| Coil L1 Current (amperes) | 31,500 | 8,000 |
| Coil L1 Voltage (volts) | 1,700 | 11 |
| Power, L1 Coil (kW) | 5,000 | 40 |

Coil L1 voltage is calculated from the product of the magnitude of coil L1 current and the magnitude of coil L1 impedance (reactive and resistive) for the appropriate power source.

Consequently, the heating power source 12 supplies 31,500 amperes to coil L1 and approximately 425 amperes (determined by dividing coil L1 voltage for heating power source 12 by the impedance of inductor L2 at heat frequency) to the input of stirring power source 16. Stirring power source 16 supplies 8,000 amperes to coil L1 and approximately 3.4 amperes (determined by dividing coil L1 voltage for stirring power source 16 by the impedance of capacitor C1 at stir frequency) to the input of heating power source 12. The approximately 425 amperes imposed on the input of the stirring power source 16, which can be a solid state, pulse width modulated supply as further described below, is deemed an acceptable current level that will not impact the performance of the stirring power source. Similarly the approximately 3.4 amperes imposed on the input of the heating power source 12, which can be a solid state, series-resonant power supply as further described below, is deemed an acceptable current level that will not impact the performance of the heating power source.

Figure 3A:
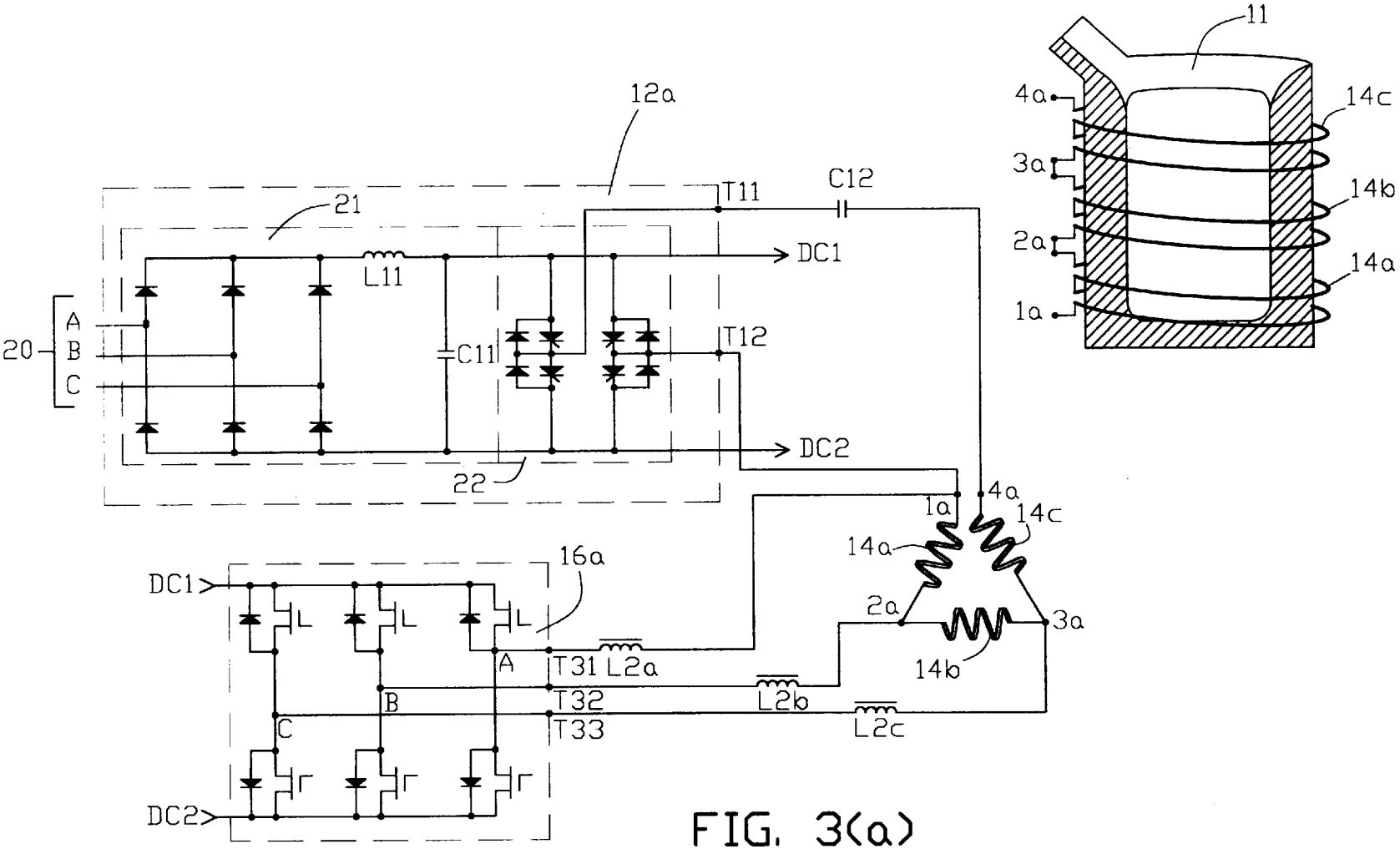
FIG. 3(*a*) is an elementary schematic diagram of one example for simultaneous induction heating and melting of an electrically conductive molten material in accordance with the present invention using a voltage-fed full bridge converter as the single-phase heating power source and a three-phase dc-to-ac inverter as the three-phase stirring power source wherein the induction coil sections disposed around the vessel are connected in an open-delta configuration relative to the three-phase stirring power source.
Figure 3B:
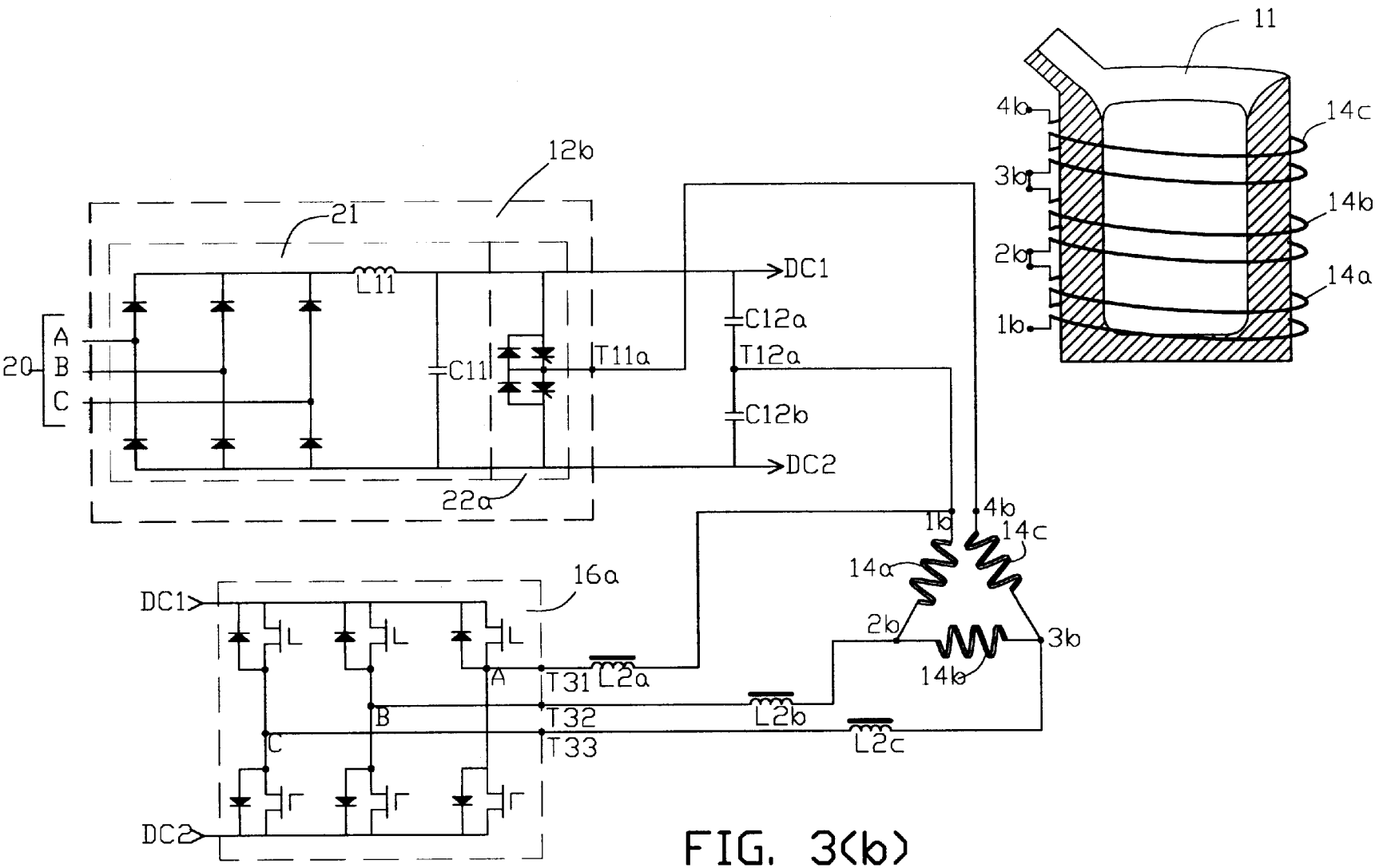

FIG. 3(*a*) illustrates another example of simultaneous induction heating and melting of an electrically conductive molten material in accordance with the present invention wherein three induction coil sections 14*a*, 14*b* and 14*c* are interconnected to form a three-phase, delta-configured impedance network. Terminals 1*a* and 4*a* of coil sections 14*a* and 14*c*, respectively, are not connected together. Therefore the circuit arrangement of the induction coil sections will be referred to as an open delta, three-phase impedance network. FIG. 3(*a*) illustrates one non-limiting example of how the three coil sections may be arranged around vessel 11 that contains the electrically conductive material. Capacitor C2 is selected to form series circuit with induction coil segments 14*a*, 14*b* and 14*c* that operates at or near resonance when connected to the heating power source. In this example, the single-phase ac heating power source is a voltage-fed, full bridge converter 12*a* utilizing an ac-to-dc rectifier section 21 that has an input from three-phase ac supply lines 20. Output terminals of the power supply's full bridge converter are designated T11 and T12. Capacitor C11 and inductor L11 filter the dc power output from the rectifier section. The filtered dc power is inverted to variable ac power in inverter section 22 of the converter. Capacitor C12 is connected between open delta terminal 4*a* of the three-phase impedance network and one output terminal, T11, of the single-phase ac supply. The second output terminal, T12, of the single-phase ac supply is connected to open delta terminal 1*a* of the three-phase impedance network. In this configuration, ac current that is supplied from the single-phase ac heating power source and flows through the coils sections creates a magnetic field that magnetically couples with the electrically conductive material inside the vessel to heat the material. The capacitance of capacitor C12 is selected to form a series resonant circuit with the three coil sections and to provide a relatively high impedance to the output of the three-phase stirring supply which operates at a stir frequency lower than the frequency of the heating power supply.

Figure 4:
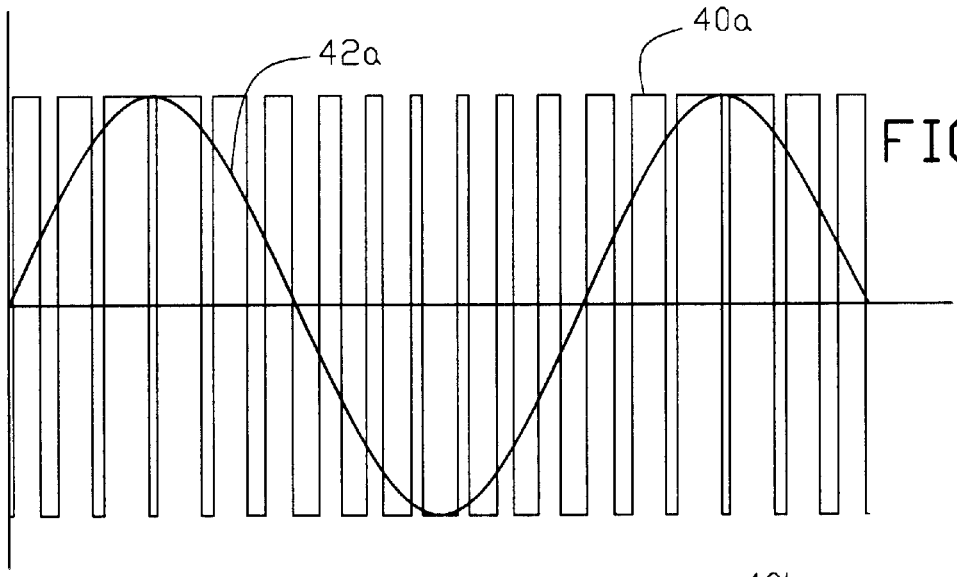
FIG. 4 is a first graphical illustration of the output current from a pulse width modulated (PWM) power supply used as a three-phase power source for electromagnetic stirring in the present invention.
Figure 5:
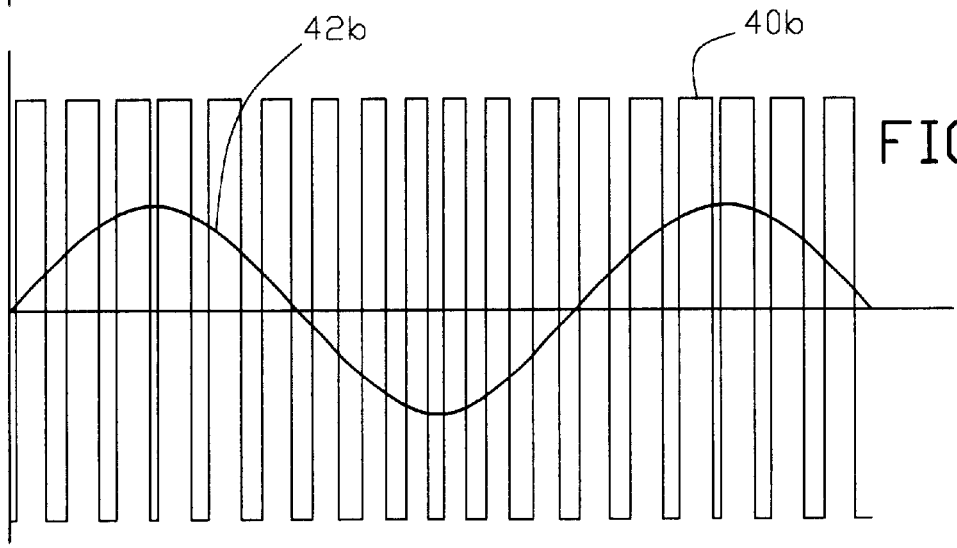
FIG. 5 is a second graphical illustration of the output current from a pulse width modulated (PWM) power supply used as a three-phase power source for electromagnetic stirring in the present invention.

Stirring power source 16*a* can be a three-phase dc-to-ac inverter that utilizes solid state switching topologies, including power transistors such as an Insulated Gate Bipolar Transistor (IGBT). Although a separate rectifier assembly could be used as an input to stirring power source 16*a*, in this particular example, rectifier assembly 21 also provides dc input to the stirring power source's inverter via interconnecting dc output positive bus DC1 and negative bus DC2. Each output line (T31, T32 and T33) of the three-phase inverter supply is connected to an end terminal of coil segments 14*a*, 14*b* and 14*c* via inductors L2*a*, L2*b* and L2*c*, respectively. Inductors L2*a*, L2*b*, and L2*c*, are power inductors (typically, but not limited to, metal core design) with approximately the same inductance, which is much greater than the inductance of a coil section. In this configuration, ac current that is supplied from the three-phase ac stirring power source and flows through the coils sections creates a magnetic field that magnetically couples with the electrically conductive material inside the vessel to electromagnetically stir the material. The inductances of inductors L2*a*, L2*b* and L2*c* are selected to form a resonant circuit with the three coil sections and to provide a relatively high impedance to the output of the single-phase heating supply that operates at a higher frequency. The output frequency of the stirring power source 16*a* will generally be less than the output frequency of the heating power source. The magnitude and frequency of the three-phase ac output from the stirring power source 16*a* can be electronically adjusted by controlling the gate timing of the power transistors with circuitry known in the art. The frequency and magnitude of stirring current drawn from stirring power source 16*a* can be varied to achieve different stirring patterns while a melt is simultaneously heated. Generally the frequency of the stirring current will affect the magnetic stirring pattern and the magnitude of the stirring current will affect the intensity of the stirring action. As illustrated in FIG. 4 and FIG. 5, if the stirring power source 16*a* operates as a PWM power supply, changing the pulse width and frequency of the output supply current pulses as illustrated by curves 40*a* and 40*b*, will result in changes of the effective magnitude and frequency of output stirring current as illustrated by curves 42*a* and 42*b*.

FIG. 3(*b*) illustrates another example of simultaneous induction heating and melting of an electrically conductive molten material in accordance with the present invention. In this example, single-phase ac heating power supply is a voltage fed half bridge converter 12*b* with half bridge inverter section 22*a*. Capacitors C12*a* and C12*b*, having approximately the same capacitance, replace capacitor C12 in FIG. 3(*a*) The output from the half bridge inverter,. The capacitors are connected in series across the positive and negative dc buses, DC1 and DC2, respectively, of the heating power supply. In this configuration, the output terminals of the heating power supply are designated as terminals T11*a* and T12*a*, with terminal T11*a* at the center of the half-bridge circuit, and terminal T12*a* at the common connection between capacitors C12*a* and C12*b*. Open-delta terminal 4*b* is connected to terminal T11*a* and open-delta terminal 1*b* is connected to terminal T12*a*. Otherwise, this example of the invention is similar to the previous example illustrated in FIG. 3(*a*).

Figure 6A:
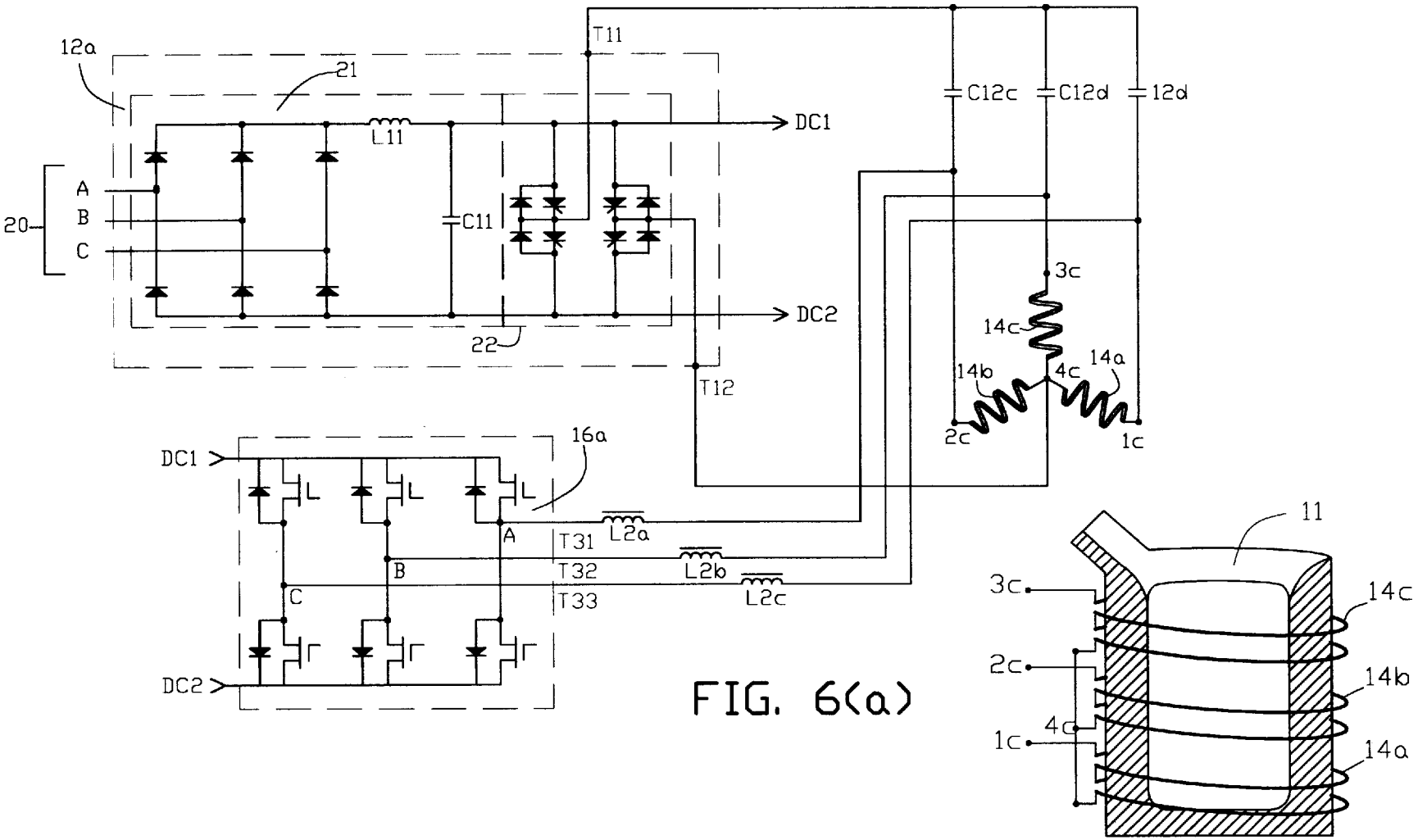
FIG. 6(*a*) is an elementary schematic diagram of another example for simultaneous induction heating and melting of an electrically conductive molten material in accordance with the present invention using a voltage-fed full bridge converter as the single-phase heating power source and a three-phase dc-to-ac inverter as the three-phase stirring power source wherein the induction coil sections disposed around the vessel are connected in a wye configuration relative to the three-phase stirring power source.
Figure 6B:
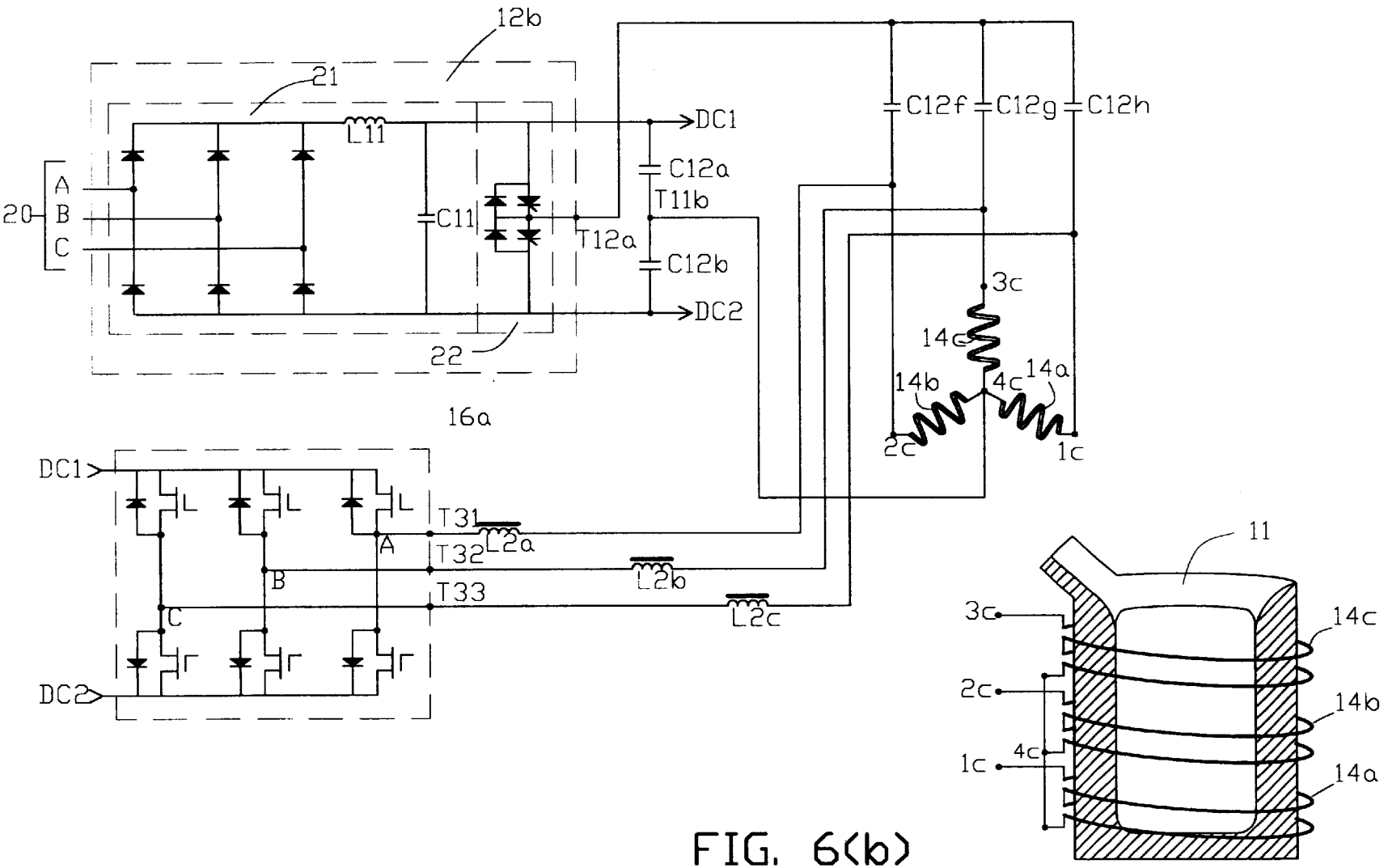

FIG. 6(*a*) illustrates another example of simultaneous induction heating and melting of an electrically conductive molten material in accordance with the present invention. This example varies from the example illustrated in FIG. 3(*a*) in that the three induction coil sections 14*a*, 14*b* and 14*c* are interconnected in a wye three-phase impedance network, rather than an open delta, three-phase impedance network. FIG. 6(*a*) illustrates one non-limiting example of how the three coil sections may be arranged around vessel 11 that contains the electrically conductive materials. The wye three-phase impedance network has phase coil terminals 1*c*, 2*c* and 3*c*, and common coil terminal 4*c* for all induction coil sections. Capacitors C12*c*, C12*d* and C12*e* have one of their terminals connected to coil terminals 1*c*, 2*c* and 3*c*, respectively. The second terminals of all theses capacitors are commonly connected to output terminal, T11, of the single-phase ac supply 12*a*. The second output terminal, T12, of the single-phase as supply is connected to common coil terminal 4*c*. Each of the output lines, T31, T32 and T33, of the three-phase inverter supply is connected to coil terminals 1*c*, 2*c* and 3*c*, respectively, of coil segments 14*a*, 14*b* and 14*c* via inductors L2*a*, L2*b* and L2*c*, respectively. Otherwise, this example of the invention is similar to the previous example illustrated in FIG. 3(*a*).

Figure 7:
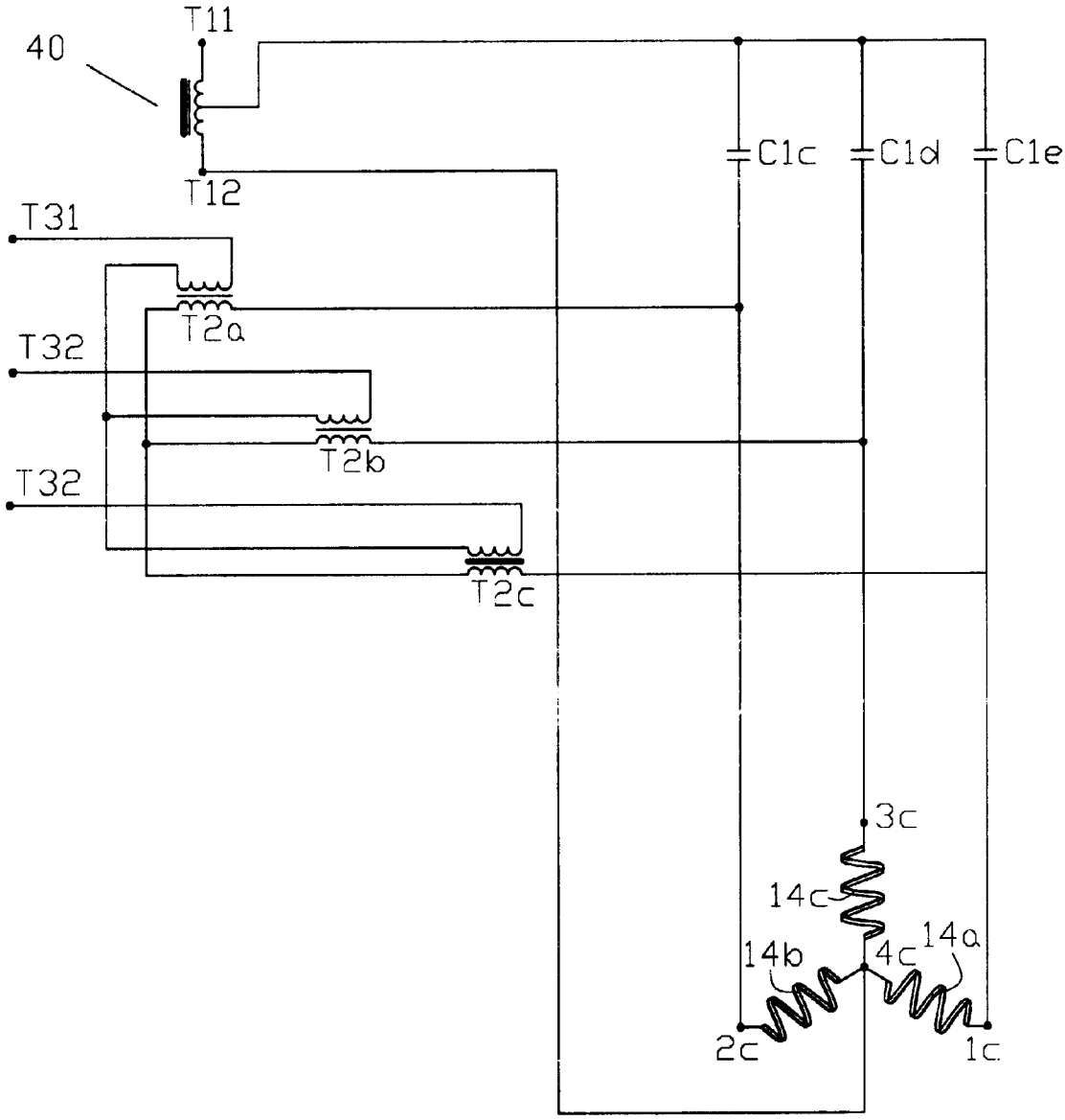
FIG. 7 schematically illustrates one method of using transformers for changing the output characteristics of a single-phase heating power supply or a three-phase stirring power supply used in examples of the invention.

FIG. 7 illustrates one method of providing a voltage step-up or step-down of the output of the single-phase ac supply in FIG. 6(*a*) by providing a autotransformer 40 across the output terminals T11 and T12 of the supply. The autotransformer may also be replaced by a conventional four-terminal transformer. Further voltage step-up or step-down of the output of the three-phase ac supply in FIG. 6(*b*) can be accomplished by using transformer elements T2*a*, T2*b* and T2*c* to replace inductors L2*a*, L2*b* and L2*c*, respectively, in FIG. 6(*a*). These voltage transformations may also be provided in other examples of the invention with appropriate modifications.

FIG. 6(*b*) illustrates another example of simultaneous induction heating and melting of an electrically conductive molten material in accordance with the present invention. This example varies from the example illustrated in FIG. 3(*b*) in that the three induction coil sections 14*a*, 14*b* and 14*c* are interconnected in a wye three-phase impedance network, rather than an open delta three-phase impedance network. Capacitors C12*f*, C12*g* and C12*h* have one of their terminals connected to coil terminals 1*c*, 2*c* and 3*c*, respectively. The second terminals of all theses capacitors are commonly connected to output terminal, T12*a*, of the single-phase ac supply 12*a*. Otherwise, this example of the invention is similar to the previous example illustrated in FIG. 6(*a*).

As illustrated by the above examples, the present invention is directed to a single-phase ac heating supply connected to the vessel's induction coil impedance network by one or more capacitive elements to form an inductive heating circuit. Components in the inductive heating circuit are selected so that the circuit is at or near resonance when driven by the heating power source operating at an inductive heating frequency. The three-phase ac stirring supply is connected to the vessel's induction coil impedance network by inductive elements to form an inductive stirring circuit. Components in the inductive stirring circuit are selected so that the circuit is at or near resonance when driven by the stirring power supply operating at an inductive stirring frequency. Further the capacitive elements and inductive elements are selected to provide sufficient impedance to block output power from the heating supply to the stirring supply, and output power from the stirring supply to the heating supply, respectively. Generally the inductive stirring frequency is less than the inductive heating frequency. Further the stir frequency may be varied over a range to provide a varied electromagnetic stir pattern. Although this will result in some off-resonant stir circuit operation, the variance from resonance will not be sufficient to negate the impedance blocking feature of the present invention.

Other types of single-phase power supplies and three-phase power supplies power supplies can be used as heating and stirring power sources, respectively, for the disclosed invention. Other three-phase induction coil configurations may be utilized without deviating from the scope of the invention. For example, the coil sections may be physically arranged around the heating vessel to achieve a particular heating and or melting variation along the height of the molten material inside the vessel. Further, multiple three-phase induction coil configurations may be provided with connections to common (parallel) heating and/or stirring power sources, or individual heating and/or stirring power sources for each of the multiple three-phase induction coils.

The examples of the invention include reference to specific electrical components. One skilled in the art may practice the invention by substituting components that are not necessarily of the same type but will create the desired conditions or accomplish the desired results of the invention. For example, single components may be substituted for multiple components or vice versa.

The foregoing embodiments do not limit the scope of the disclosed invention. The scope of the disclosed invention is further set forth in the appended claims.

What is claimed is:

1. An apparatus for simultaneously heating and stirring by magnetic induction an electrically conductive material in a vessel having a plurality of induction coils disposed around the vessel, the plurality of induction coils connected together to form at least one three-phase impedance network, the apparatus comprising:

a single-phase ac power source having an output operating at an inductive heating frequency;

a three-phase ac power source having an output operating at an inductive stirring frequency, the inductive stirring frequency less than the inductive heating frequency, at least one capacitive element connecting the output of the single-phase ac power source to the plurality of induction coils to form a heating circuit operative at or near resonant frequency to supply an ac heating current to the plurality of induction coils, the ac heating current creating in use a heating magnetic field, the heating magnetic field inductively coupled with the electrically conductive material to heat the electrically conductive material; and at least one inductive element connecting the output of the three-phase ac power source to the plurality of induction coils to form a stirring circuit operative at or near resonant frequency to supply an ac stirring current to the plurality of induction coils, the ac stirring current creating in use a stirring magnetic field, the stirring magnetic field inductively coupled with the electrically conductive material to stir the electrically conductive material;

whereby the at least one capacitive element substantially blocks the output of the three-phase power source from the output of the single-phase ac power source and the at least one inductive element blocks the output of the single-phase ac power source from the output of the three-phase ac power source.

2. An apparatus for simultaneous induction heating and stirring of an electrically conductive material in a vessel, the apparatus comprising:

a plurality of induction coils disposed around the vessel, the plurality of induction coils connected together to form an at least one three-phase impedance network comprising an open delta circuit having a first and second open delta terminals and a first and second closed delta terminals;

a heat circuit capacitor having a first capacitor terminal and a second capacitor terminal, the first capacitor terminal connected to the first open delta terminal;

a single-phase ac power supply, the single-phase ac power supply having a first and a second output heat supply terminals, the first output heat supply terminal connected to the second capacitor terminal, and the second output heat supply terminal connected to the second open delta terminal, the single-phase ac power supply operating at a heat frequency;

a plurality of stir circuit inductors, each one of the plurality of stir circuit inductors having a first inductor terminal and a second inductor terminal, the first inductor terminal of each one of the plurality of stir circuit inductors connected exclusively to the first closed delta terminal, the second closed delta terminal, and the second open delta terminal of the at least one three-phase impedance network; and a three-phase ac power supply having three output stir supply terminals, each of the three output stir supply terminals connected exclusively to the second inductor terminal of each one of the plurality of stir circuit inductors, the three-phase ac power supply operating at a stir frequency, the stir frequency less than the heat frequency, whereby the single-phase ac power supply provides inductive heat power to the at least one three-phase impedance network to heat the electrically conductive material and the plurality of stir circuit inductors substantially blocks heat power from the single-phase ac power supply. The three-phase ac power supply, and the three-phase ac power supply provides stir power to the at least one three-phase impedance network to stir the electrically conductive material and the heat circuit capacitor substantially blocks stir power from the three-phase ac power supply to the single-phase ac power supply.

3. The apparatus of claim 2, wherein the stir frequency is variable over a frequency range.

4. The apparatus of claim 2, wherein the three-phase ac power supply is a pulse width modulated power supply having a variable frequency output.

5. An apparatus for simultaneous induction heating and stirring of an electrically conductive material in a vessel, the apparatus comprising:

a plurality of induction coils disposed around the vessel, the plurality of induction coils connected together to form at least one three-phase impedance network comprising an open delta circuit having a first and second open delta terminals and a first and second closed delta terminals;

a first heat circuit capacitor and a second heat circuit capacitor, the first and second heat circuit capacitors having approximately the same capacitance, each of the first and second heat circuit capacitors having a first and second terminals, the second terminals of the first and second heat circuit capacitors connected together to form a common capacitor connection;

a single-phase ac power supply, the single-phase heating power supply having a positive dc bus and a negative dc bus, and a first and second output heat supply terminals, the first output heat supply terminal comprising the center of a half-bridge circuit of the single-phase ac power supply, the positive dc bus connected to the first terminal of the first heat circuit capacitor and the negative dc bus connected to the first terminal of the second heat circuit capacitor, the single-phase ac power supply operating at a heat frequency;

a plurality of stir circuit inductors, each one of the plurality of stir circuit inductors having a first inductor terminal and a second inductor terminal, the first inductor terminal of each one of the plurality of stir circuit inductors connected exclusively to the first closed delta terminal, the second closed delta terminal, and the second open delta terminal of the at least one three-phase impedance network; and a three-phase ac power supply having three output stir supply terminals, each of the three output stir supply terminals connected exclusively to the second inductor terminal of each one of the plurality of stir circuit inductors, the three-phase ac power supply operating at a stir frequency, the stir frequency less than the heat frequency, whereby the single-phase ac power supply provides heat power to the at least one three-phase impedance network to heat the electrically conductive material and the plurality of stir circuit inductors effectively blocks heat power from the single-phase ac power supply to the three-phase ac power supply, and the three-phase ac power supply provides stir power to the at least one three-phase impedance network to stir the electrically conductive material and the heat circuit capacitors effectively blocks stir power from the three-phase ac power supply to the single-phase ac power supply.

6. The apparatus of claim 5, wherein the stir frequency is variable over a frequency range.

7. The apparatus of claim 5, wherein the three-phase ac power supply is a pulse width modulated power supply having a variable frequency output.

8. An apparatus for simultaneous induction heating and stirring an electrically conductive material in a vessel, the apparatus comprising:

a plurality of induction coils disposed around the vessel, the plurality of induction coils connected together to form at least one three-phase impedance network comprising a wye circuit having a common.terminal for all of the plurality of induction coils, and a first, second and third terminals;

a plurality of heat circuit capacitors, each one of the plurality of heat circuit capacitors having a first capacitor terminal and a second capacitor terminal, the first capacitor terminal of each one of the plurality of heat circuit capacitors connected exclusively to the first, second and third terminals of the at least one three-phase impedance network;

a single-phase ac power supply, the single-phase ac power supply having a first and second output heat supply terminals, the first output heat supply terminal connected to the second capacitor terminal of all of the plurality of heat circuit capacitors, and the second output heat supply terminal connected to the common terminal of the at least one three-phase impedance network, the single-phase ac power supply operating at a heat frequency;

a plurality of stir circuit inductors, each one of the plurality of stir circuit inductors having a first inductor terminal and a second inductor terminal, the first inductor terminal of each one of the plurality of stir circuit inductors connected exclusively to the first, second and third terminals of the three-phase impedance network; and a three-phase ac power supply having a three output stir supply terminals, each of the three output stir supply terminals connected exclusively to the second inductor terminal of each one of the plurality of stir circuit inductors, the three-phase ac power supply operating at a stir frequency, the stir frequency less than the heat frequency, whereby the single-phase ac power supply provides inductive heat power to the at least one three-phase impedance network to heat the electrically conductive material and the plurality of stir circuit inductors substantially blocks heat power from the input to the three-phase ac power supply, and the three-phase ac power supply provides stir power to the at least one three-phase impedance network to stir the electrically conductive material and the plurality of heat circuit capacitors substantially blocks stir power from the three-phase ac power supply the single-phase ac power supply.

9. The apparatus of claim 8, wherein the stir frequency is variable over a frequency range.

10. The apparatus of claim 8, wherein the three-phase ac power supply is a pulse width modulated power supply having a variable frequency output.

11. An apparatus for simultaneous induction heating and stirring an electrically conductive material in a vessel, the apparatus comprising:

a plurality of induction coils disposed around the vessel, the plurality of induction coils connected together to form at least one three-phase impedance network comprising a wye circuit having a common terminal for all of the plurality of induction coils, and a first, second and third terminals;

a plurality of heat circuit capacitors, each one of the plurality of heat circuit capacitors having a first capacitor terminal and a second capacitor terminal, the first capacitor terminal of each one of the plurality of heat circuit capacitors connected exclusively to the first, second and third terminals of the three-phase impedance network;

a single-phase ac power supply, the single-phase ac power supply having a first and second output heat supply terminals, the first output heat supply terminal connected to the second capacitor terminal of all the plurality of heat circuit capacitors, and the second output heat supply terminal connected to the common terminal of the three-phase impedance network, the single-phase ac power supply;

a plurality of stir circuit inductors, each one of the plurality of stir circuit inductors having a first inductor terminal and a second inductor terminal, the first inductor terminal of each one of the plurality of stir circuit inductors connected exclusively to the first, second and third terminals of the three-phase impedance network; and a three-phase ac power supply having three output terminals, each of the three output terminals connected exclusively to the second inductor terminal of one of the plurality of stir circuit inductors, the three-phase ac power supply operating at a stir frequency, the stir frequency less than the heat frequency, whereby the single-phase ac power supply provides heat power to the at least one three-phase impedance network to heat the electrically conductive material and the plurality of stir circuit inductors effectively blocks heat power from the single-phase ac power supply to the three-phase ac power supply, and the three-phase ac power supply provides stir power to the at least one three-phase impedance network to stir the electrically conductive material and the heat circuit capacitor effectively blocks stir power from the three-phase ac power supply to the single-phase ac power supply.

12. The apparatus of claim 11, wherein the stir frequency is variable over a frequency range.

13. The apparatus of claim 11, wherein the three-phase ac power supply is a pulse width modulated power supply having a variable frequency output.

14. A method of simultaneously heating and stirring by magnetic induction an electrically conductive material in a vessel having a plurality of induction coils disposed around the vessel, the plurality of induction coils connected together to form at least one three-phase impedance network, the method comprising the steps:

providing a single-phase ac power source having an output operating at an inductive heating frequency;

providing a three-phase ac power source having an output operating at an inductive stirring frequency, the inductive stirring frequency less than the inductive heating frequency, connecting the output of the single-phase ac power source to the plurality of induction coils by at least one capacitive element to form a heating circuit operating at or near resonant frequency to supply an ac heating current to the plurality of induction coils, the ac heating current creating a heating magnetic field, the heating magnetic field inductively coupled with the electrically conductive material to heat the electrically conductive material; and connecting the output of the three-phase ac power source to the plurality of induction coils by at least one inductive element to form a stirring circuit operating at or near resonant frequency to supply an ac stirring current to the plurality of induction coils, the ac stirring current creating a stirring magnetic field, the stirring magnetic field inductively coupled with the electrically conductive material to stir the electrically conductive material;

whereby the at least one capacitive element substantially blocks the output of the three-phase power supply from the output of the single-phase ac power supply and the at least one inductive element blocks the output of the single-phase supply from the output of the three-phase supply.

15. The method of claim 14, further comprising the step of varying the frequency of the output of the three-phase ac power source.

16. The apparatus of claim 14, wherein the three-phase ac power supply is a pulse width modulated power supply having a variable frequency output.

* * * * *